US009644921B1

(12) United States Patent
LoRocco et al.

(10) Patent No.: US 9,644,921 B1
(45) Date of Patent: May 9, 2017

(54) SIGHT ASSEMBLY WITH ILLUMINATED SIGHT POINT

(71) Applicant: TruGlo, Inc., Richardson, TX (US)

(72) Inventors: Paul LoRocco, Dallas, TX (US); John Estridge, Plano, TX (US)

(73) Assignee: TruGlo, Inc., Richardson, TX (US)

( * ) Notice: Subject to any disclaimer, the term of this patent is extended or adjusted under 35 U.S.C. 154(b) by 56 days.

(21) Appl. No.: 14/695,840

(22) Filed: Apr. 24, 2015

Related U.S. Application Data

(60) Provisional application No. 61/969,501, filed on Mar. 24, 2014.

(51) Int. Cl.
*F41G 1/467* (2006.01)

(52) U.S. Cl.
CPC ..... *F41G 1/467* (2013.01)

(58) Field of Classification Search
CPC ... F41G 1/467; F41G 1/30; F41G 1/38; F41G 1/345
USPC ..... 33/265; 124/87; 42/113, 123
See application file for complete search history.

(56) References Cited

U.S. PATENT DOCUMENTS 2,171,571 A * 9/1939 Karnes ..... G02B 27/34 42/123
3,098,303 A * 7/1963 Plisk ..... F41G 1/32 42/145
4,177,572 A 12/1979 Hindes
4,220,983 A * 9/1980 Schroeder ..... F41G 1/467 33/265
4,638,565 A * 1/1987 Podany ..... F41G 1/467 33/265
4,813,150 A 3/1989 Colvin
4,977,677 A * 12/1990 Troescher, Jr. ..... F41G 1/467 124/87
5,148,603 A * 9/1992 Beutler ..... F41G 1/467 33/265
5,791,060 A * 8/1998 Godsey ..... F41G 1/467 124/87
5,850,700 A * 12/1998 Capson ..... F41G 1/467 33/265
7,162,806 B1 * 1/2007 Swiggart ..... F41G 1/467 124/87
7,502,166 B2 * 3/2009 Stenton ..... F41G 1/345 359/428
8,925,238 B2 * 1/2015 Anderson ..... F41G 1/08 42/114
9,389,045 B2 * 7/2016 Reichert ..... F41G 1/30
2014/0041277 A1 * 2/2014 Hamilton ..... F41G 1/345 42/122
2014/0152981 A1 6/2014 Lim et al.

FOREIGN PATENT DOCUMENTS

WO WO2012165752 A1 12/2012

* cited by examiner

*Primary Examiner* — Christopher Fulton
(74) *Attorney, Agent, or Firm* — Alvin R. Wirthlin

(57) ABSTRACT

A sight assembly for aiming at a distant target by a user includes a sight housing having a sight window; a lens connected to the housing in alignment with the sight window; a depression formed with the lens; and an illuminated sight point for superimposing on the distant target. The illuminated sight point includes an artificial light source located in the depression. In this manner, the light source is protected from the outside environment to thereby protect the light source against inadvertent separation from the lens.

20 Claims, 9 Drawing Sheets

SIGHT ASSEMBLY WITH ILLUMINATED SIGHT POINT

CROSS-REFERENCE TO RELATED APPLICATIONS

This application claims the benefit of U.S. Provisional Application No. 61/969,501 filed on Mar. 24, 2014, the disclosure of which is hereby incorporated by reference.

BACKGROUND OF THE INVENTION

This invention relates generally to sights for acquiring a distal target, and more specifically to illuminated sights having an artificially lighted sight point.

One major component of a traditional archery sight is the front circular sight aperture used for aiming. During aiming, the sight aperture is optically aligned with the rear circular peep (located in the bowstring) to form a sight picture used for consistent aiming. Sight apertures typically have pins for the different yardages, such as 20, 30, 40 yards, and so on. Throughout the years, many sight apertures with different configurations, each offering their own advantages, have been proposed. For example, sight apertures have included different geometries such as circular shapes, D shapes, oval shapes, and so on, as well as different configurations for the sight pins or sight points, such as brass pins, black pins, fiber optic glow pins, red dot sights, and so on.

Although such sight pins are adequate for their intended use in many cases, the relative brightness and size of such pins can be difficult to control. With a wide variability in ambient light conditions and distances between a user and a target, the control of the brightness and size of such devices becomes important. In addition, the provision of large sight pins or illuminated dots, as well as a plurality of sight pins within the same sight aperture, can result in partial or complete obscuration of the target. In an effort to overcome some of these disadvantages, an archery sight assembly has been proposed where a LED is bonded to the surface of a lens and used as a sight dot that reduces target obscuration while allowing adequate control over the LED brightness. However, this system is problematic in that the LED may be inadvertently bumped, scratched, or contacted by the user, brush, or other foreign objects under typical hunting conditions.

It would therefore be desirable to provide a sight assembly that overcomes one or more disadvantages of the prior art.

SUMMARY OF THE INVENTION

In accordance with one aspect of the invention, a sight assembly for aiming at a distant target by a user includes a sight housing having a sight window; a lens connected to the housing in alignment with the sight window; a depression formed with the lens; and an illuminated sight point for superimposing on the distant target. The illuminated sight point includes an artificial light source located in the depression. In this manner, the light source is protected from the outside environment to thereby protect the light source against inadvertent separation from the lens.

In accordance with a further aspect of the invention, an archery sight incorporating the above-described sight assembly also includes a bracket assembly having a first bracket portion for connection to an archery bow; and a second bracket portion connected to the sight assembly. The second bracket portion is adjustable along windage and elevation directions with respect to the first bracket portion to thereby permit the sight assembly to be tuned in for a particular set of archery parameters, such as the draw weight of the bow, the arrow size, the size of a user, and so on.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
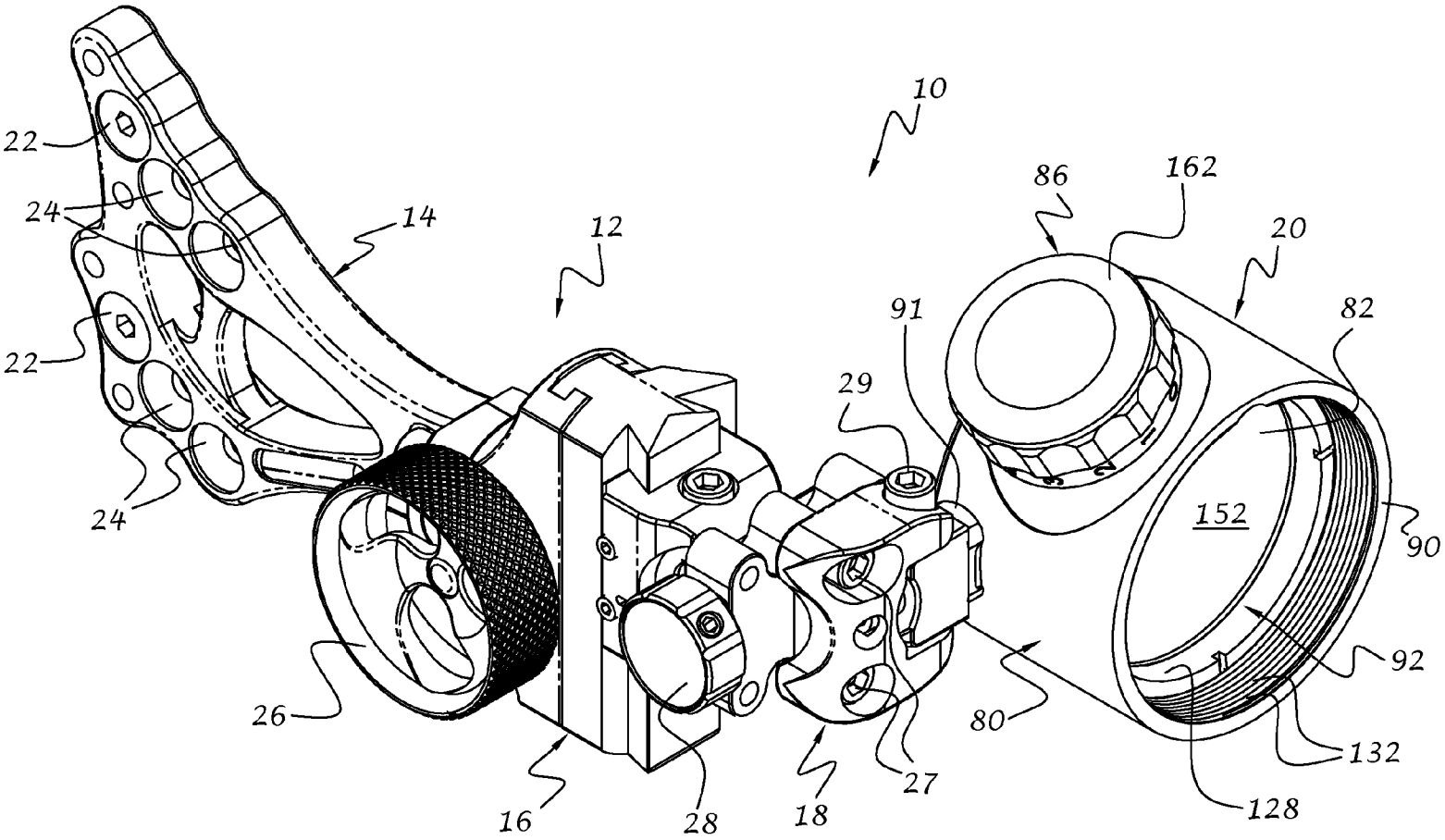
FIG. 1 is a an isometric right-front view of an archery sight in accordance with an exemplary embodiment of the invention.
Figure 2:
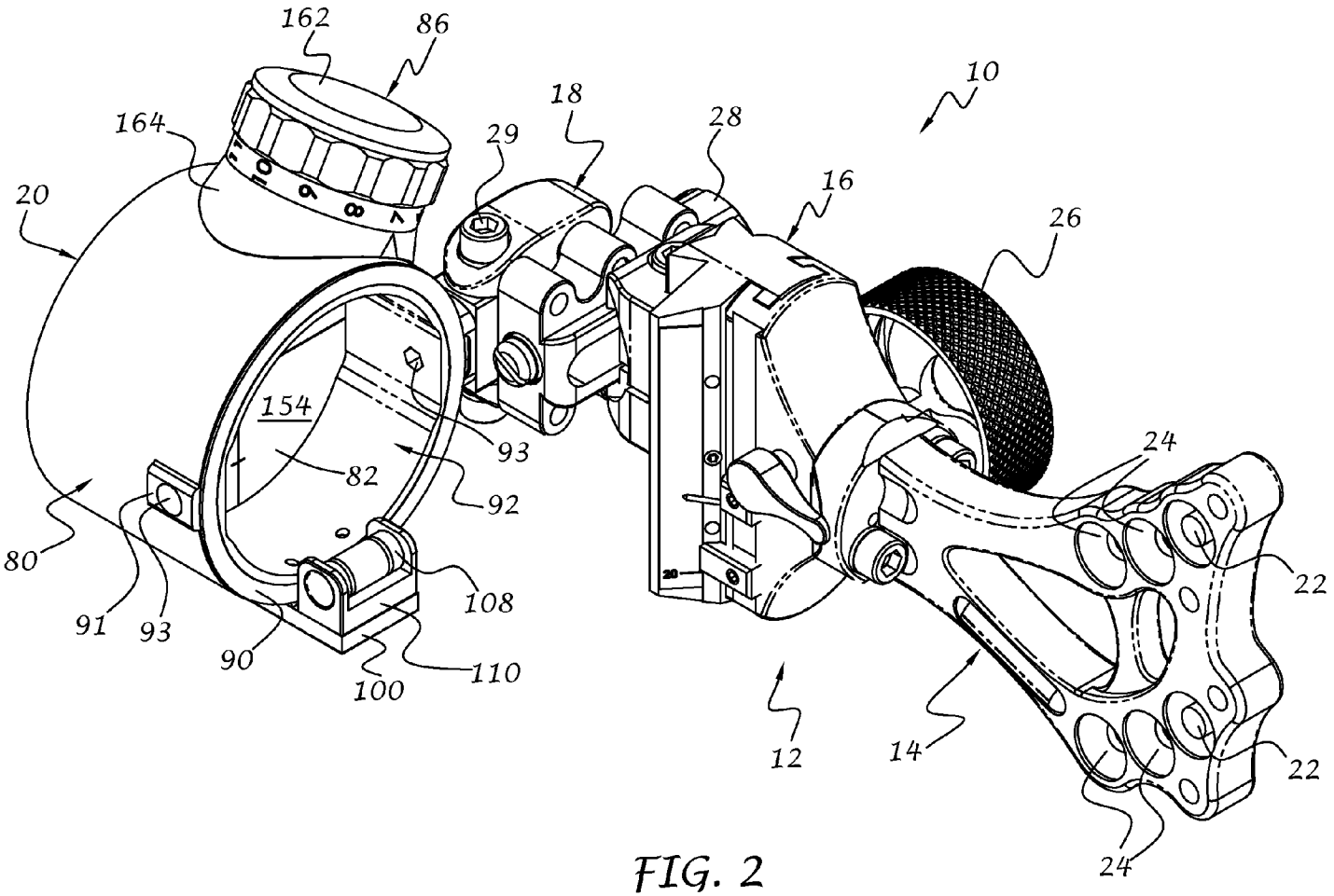
FIG. 2 is an isometric left rear view thereof.

Referring to the drawings, and to FIGS. 1 and 2 in particular, an illuminated sighting device 10 in accordance with the present invention is illustrated. The sighting device 10 as shown is embodied as a bow sight. To this end, the sighting device 10 preferably includes a bracket assembly 12 having a bracket portion 14, an adjustment portion 16 connected to the bracket portion 14, an articulated support portion 18 connected to the adjustment member 16, and a sight assembly 20 connected to the articulated support portion 18 for providing one or more luminous sight points (not shown in FIGS. 1 and 2) for aiming at a distant target. The bracket portion 14 is useful for attaching the sighting device 10 to a bow (not shown) or the like via fasteners 22 that extend through openings 24 in the bracket portion 14 and into the riser of a bow (not shown) in a conventional manner. The adjustment portion 16 is useful for changing the elevation of the sight assembly 20 via an adjustment wheel 26, while the articulated support portion 18 is useful for changing the windage adjustment of the sight assembly 20 via an adjustment knob 28 and orienting the sight assembly 20 about three mutually perpendicular axes via fasteners 27 and 29, as well as their related hardware. Further details of the bracket assembly 12, including the bracket portion 14, adjustment portion 16, and the articulated support portion 18 can be found in U.S. patent Ser. No. 13/920,858 filed on Jun. 18, 2013, the disclosure of which is hereby incorporated by reference.

Figure 3:
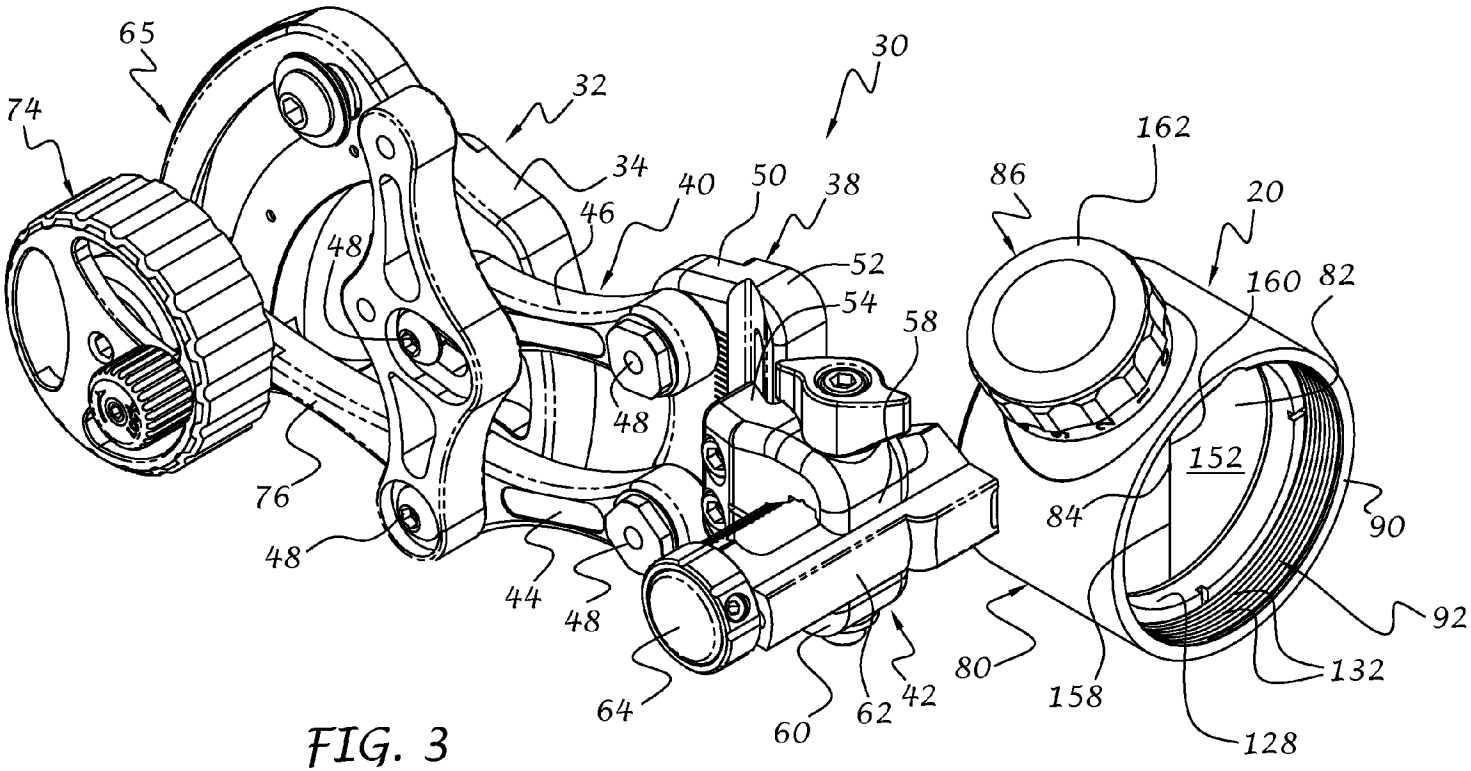
FIG. 3 is an isometric right-front view of an archery sight in accordance with a further exemplary embodiment of the invention.
Figure 4:
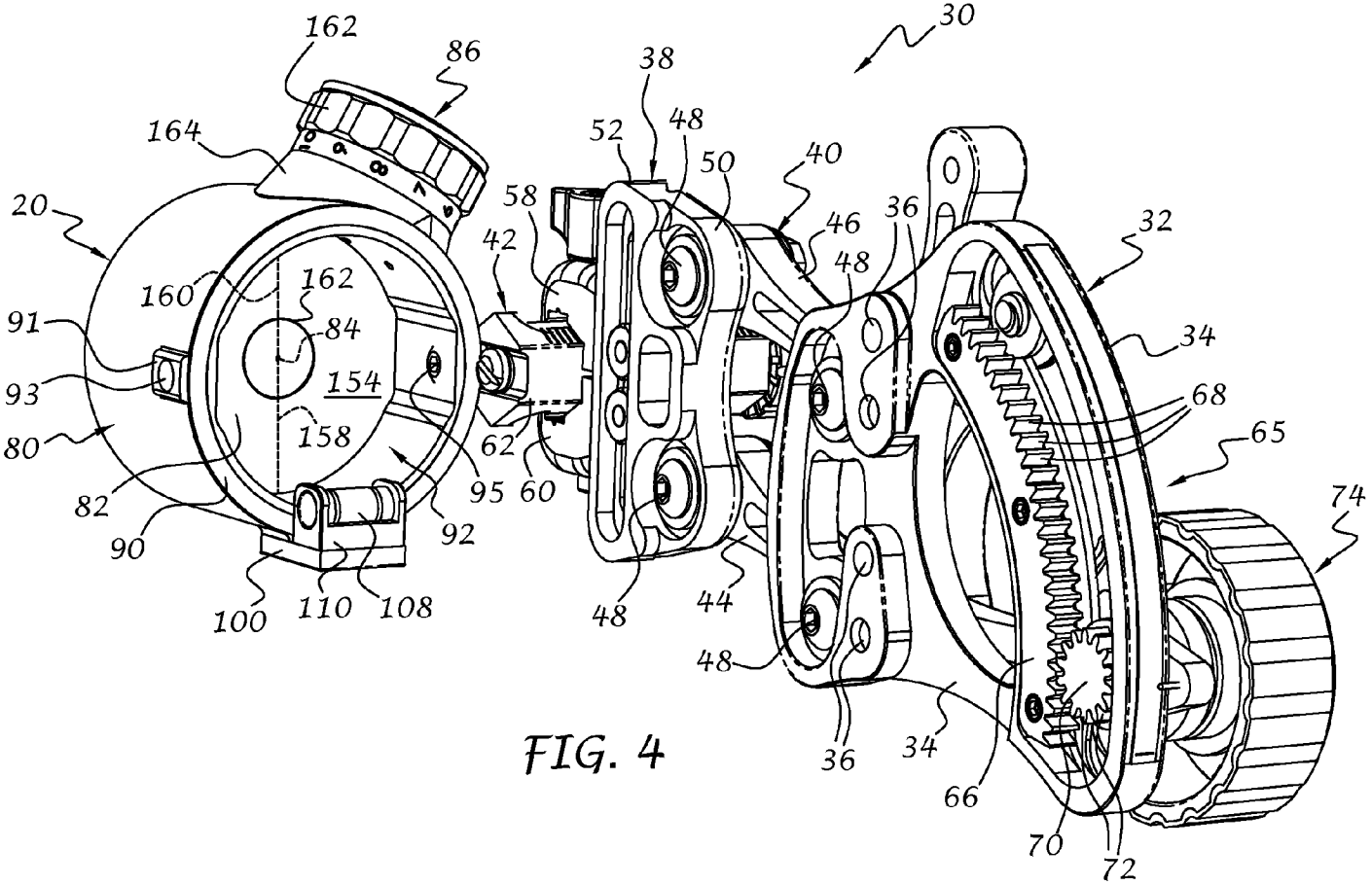
FIG. 4 is an isometric left rear view thereof.

Referring now to FIGS. 3 and 4, an illuminated sighting device 30 in accordance with a further exemplary embodiment of the present invention is illustrated. The sighting device 30 as shown is embodied as a bow sight. To this end, the sighting device 30 preferably includes a bracket assembly 32 adapted for connection to the riser of an archery bow (not shown) and can receive archery accessories, such as a quiver or the like (not shown) for holding arrows (not shown), as well as the sight assembly 20.

The bracket assembly 32 preferably includes a first bracket portion 34 with openings 36 (FIG. 4) formed therein for receiving fasteners (not shown) that thread into the bow structure in a conventional manner, a second bracket portion 38 connected to the first bracket portion 34 via a range adjustment portion 40 for adjusting the height or elevation of the sight assembly 20, and a windage adjustment portion 42 connected between the second bracket portion 38 and the sight assembly 20 for adjusting the windage or horizontal position of the sight assembly.

The range adjustment portion 40 includes a first pivot arm 44 and a second pivot arm 46 pivotally connected to the first bracket portion 34 and second bracket portion 38 via pivot joint assemblies 48 to thereby form a four-bar linkage.

The second bracket portion 38 preferably includes a plate portion 50 and a dovetail portion 52 extending forwardly of the plate portion for receiving a complementary shaped jaw 54 of the windage adjustment portion 42 so that the height of the windage adjustment portion, and thus the sight assembly 20, can be adjusted. The windage adjustment portion 42 also includes a pair of jaws 58 and 60 that clamp around a windage bar 62 for micro-adjusting a windage position of the sight assembly 20 via an adjustment knob 64. (FIG. 3).

A range adjustment assembly 65 is associated with the first bracket portion 34 and preferably includes an arcuate first gear 66 (FIG. 4) with teeth 68 connected to the first bracket portion 34, a second gear 70 with teeth 72 that engage the teeth 68 of the first gear 66, and a drive wheel 74 connected to the second gear 70 for rotation therewith. The second pivot arm 46 includes an extension section 76 operably associated with the second gear 70 so that the second gear rotates along the first gear during pivotal movement of the second pivot arm 46 as the drive wheel 74 is rotated, to thereby adjust the range or elevation of the sight assembly 20. Further details of the bracket assembly 32 can be found in U.S. application Ser. No. 14/224,597 filed on Mar. 25, 2014, the disclosure of which is hereby incorporated by reference.

It will be understood that the sight assembly 20 is not limited for use with archery equipment, but may be adapted for use with any projectile launching device such as a crossbow, rifle, pellet gun, BB gun, pistol, paint marker, and the like, and can be adapted for use with other devices, such as telescopes, sighting scopes, and so on, in order to quickly align the device with a distal target or scene. Accordingly, the sight assembly 20 is not limited to the particular bracket assemblies shown and described, but may be adapted for use with other archery brackets, as well as any suitable mounting arrangement without departing from the spirit and scope of the invention.

Figure 5:
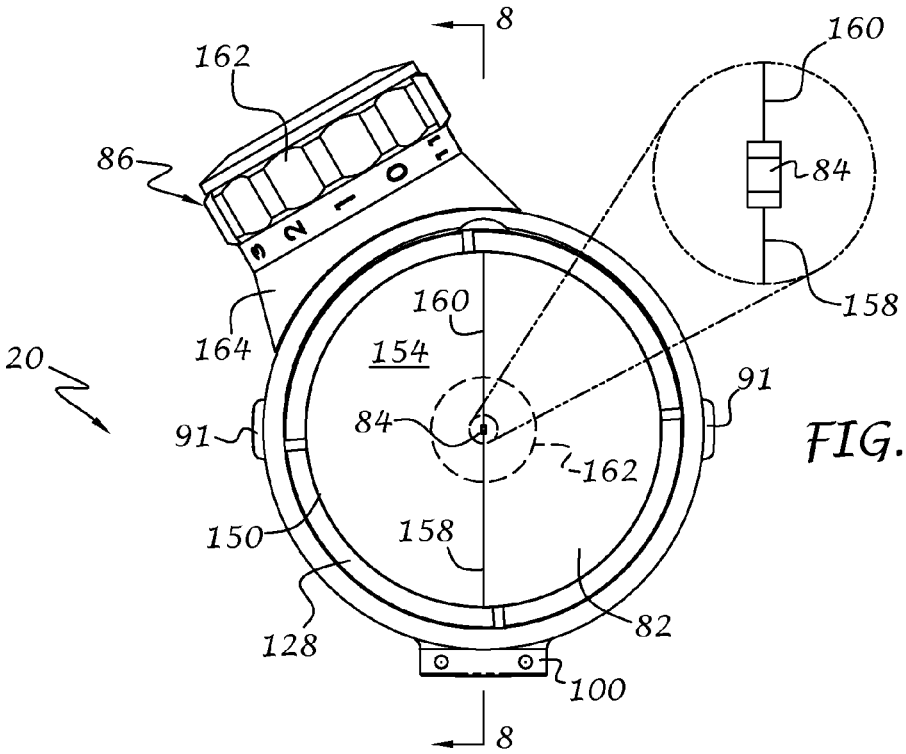
FIG. 5 is a front elevational view of a sight assembly of the archery sight embodiments of FIGS. 1 and 3, and showing a light source mounted in a forward face of a lens associated with the sight assembly in accordance with an exemplary embodiment of the invention.
Figure 6:
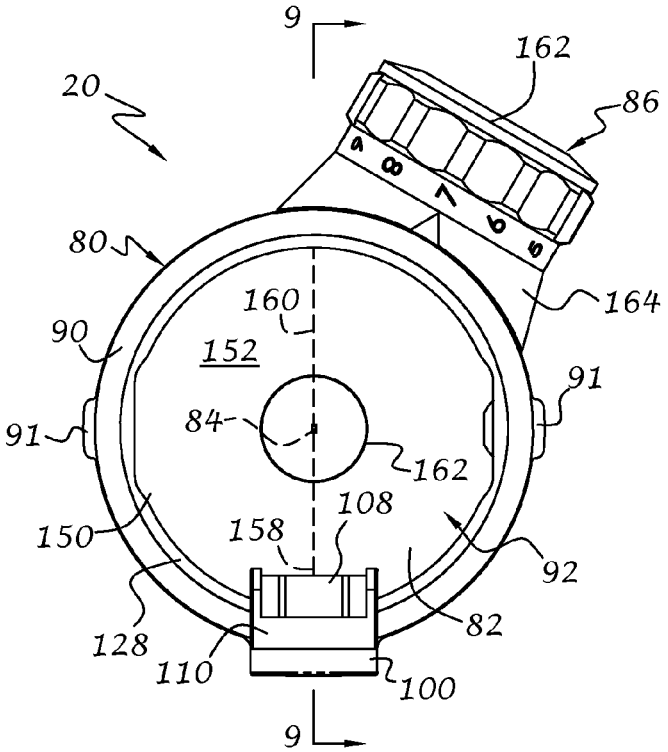
FIG. 6 is a rear elevational view thereof showing the light source and circular aiming indicia centered about the light source.
Figure 7:
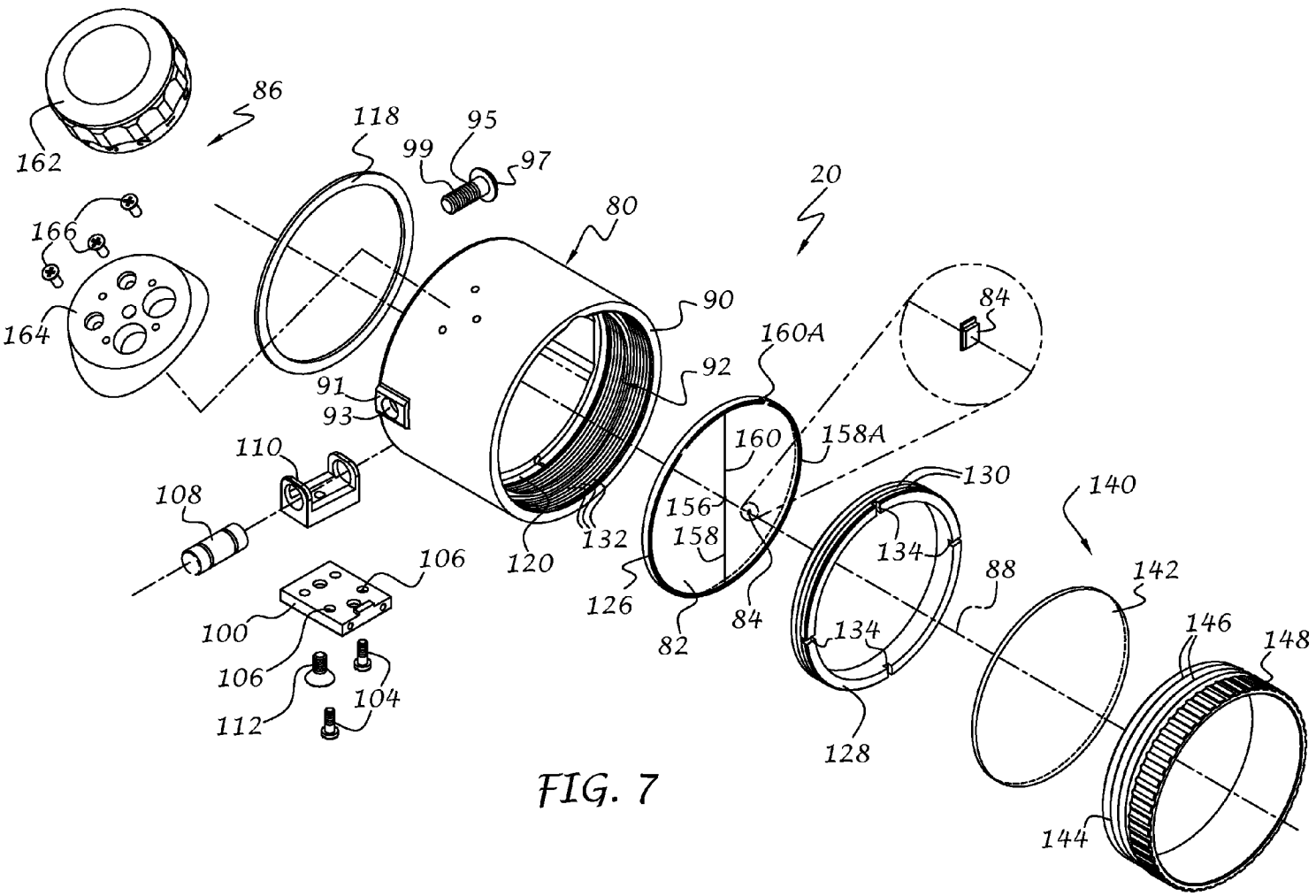
FIG. 7 is a right front isometric exploded view of the sight assembly with an additional lens module for connection thereto.

With additional reference to FIGS. 5-7, the sight assembly 20 preferably includes a frame portion 80 for connection to a bracket assembly or the like, as previously described, at least one lens or lens assembly 82 located within the frame portion 80, an illuminated sight point or dot 84 connected to the lens 82, and an electrical power source 86 mechanically connected to the frame portion 80 and electrically connected to the sight point 84 for selectively illuminating and controlling the brightness thereof. The term "lens" as used herein refers to a transparent body that can function as a window, e.g. the front and rear surfaces of the lens are flat so that an image as viewed through the lens is at least substantially unmodified, and can also refer to one or more curved surfaces and/or combinations of lenses to modify the image as viewed through the lens, such as magnification or reduction of the image, as well as lens materials that may be translucent in nature and/or surface coatings to filter, block, reflect, or refract certain wavelengths of light for a desired effect.

In accordance with one exemplary embodiment of the invention, the present invention utilizes a miniature surface-mount LED as the sight point or dot, and encapsulates the LED in a clear lens that mounts centrally inside an aperture window. The LED brightness can be controlled, allowing this illuminated LED to be used for aiming since it can be located at the central axis of the aperture window, coincident with crosshairs or other aiming patterns. The frame portion 80 preferably includes a generally circular wall or housing 90 that forms a sight aperture or window 92 within which the at least one lens 82 with the attached sight point 84 are received. The housing 90 is dark in color to reduce light reflection, especially within the sight window 92. The housing 90 includes mounting bosses 91 formed at opposite sides of the housing with an opening 93 extending through each boss for receiving a fastener 95. The fastener 95 has a head 97 that rests against the inner surface of the housing and a threaded shaft 99 that extends through the opening 93 and threads into a windage adjustment arm or similar structure of the bracket assemblies or the like. The provision of two bosses facilitates mounting the sight assembly 20 for both right-handed and left-handed users.

The sight point 84 as shown is preferably connected to the lens 82 at a common central axis 88 (FIG. 7) of the lens 82 and the circular wall 90, and functions as an illuminated sight dot for acquiring a distant target. Preferably, the sight point 84 comprises a light source, such as an ultra-miniature surface-mount light-emitting diode (LED) that emanates radiant energy in the visible light spectrum for viewing by a user during aiming.

However, it will be understood that the invention is not limited to LED's or to ultra-miniature LED's or even the visible light spectrum, but can alternatively include other illumination means such as incandescent bulbs, tritium capsules, and/or other artificial light sources that transmit radiant energy in the visible light or infrared spectrums, without departing from the spirit and scope of the invention.

Moreover, it will be understood that the sight point 84 can be connected to the lens 82 at other locations besides the center thereof. It will be further understood that multiple sight points or LED's can be positioned at different locations or elevations on the lens 82 indicative of different aiming positions dependent on different distances between the user and a target.

The sight window 92 can be closed (as shown) or open, in accordance with a further embodiment of the invention, with a portion or portions of the wall 90 removed, and be of any suitable shape. The sight window 92 serves to at least partially frame a distal target to thereby facilitate aiming. A mounting plate 100 (FIGS. 7-9) is connected to a lower surface 102 of the frame portion 80 via fasteners 104 that extend through openings 106 formed in the mounting plate 100 and thread into openings (not shown) formed in the lower surface 102. A bubble level 108 is located within an adjustable holder 110 which is in turn connected to the mounting plate 100 via a fastener 112 for assisting a user to properly orient the sight assembly 20 during aiming.

The housing 90 also includes an annular recess 114 (FIG. 8) formed at the rear end 116 for receiving an aperture ring 118 to facilitate viewing the sight window 92 by a user during aiming, especially in low light conditions. The aperture ring 118 can be formed of a material having light reflective or enhancing features, such as reflective material, glow material, light colored material, and so on. An annular internal shoulder 120 extends radially inwardly from an inner surface 122 of the housing 90 and is located between the rear end 116 and forward end 124 of the housing 90. An outer periphery 126 of the lens 82 is sandwiched between the internal shoulder 120 and a locking ring 128 to secure the lens 82 in place. The locking ring 128 includes external threads 130 that engage internal threads 132 formed in the inner surface 122 of the housing 90. The internal threads 132 extend from the forward end 124 of the housing 90 towards the internal shoulder 120. Forward facing slots 134 (FIG. 7) are formed equidistantly around the locking ring 128 for engagement with a spanner wrench (not shown) or the like when installing or removing the locking ring.

Figure 8:
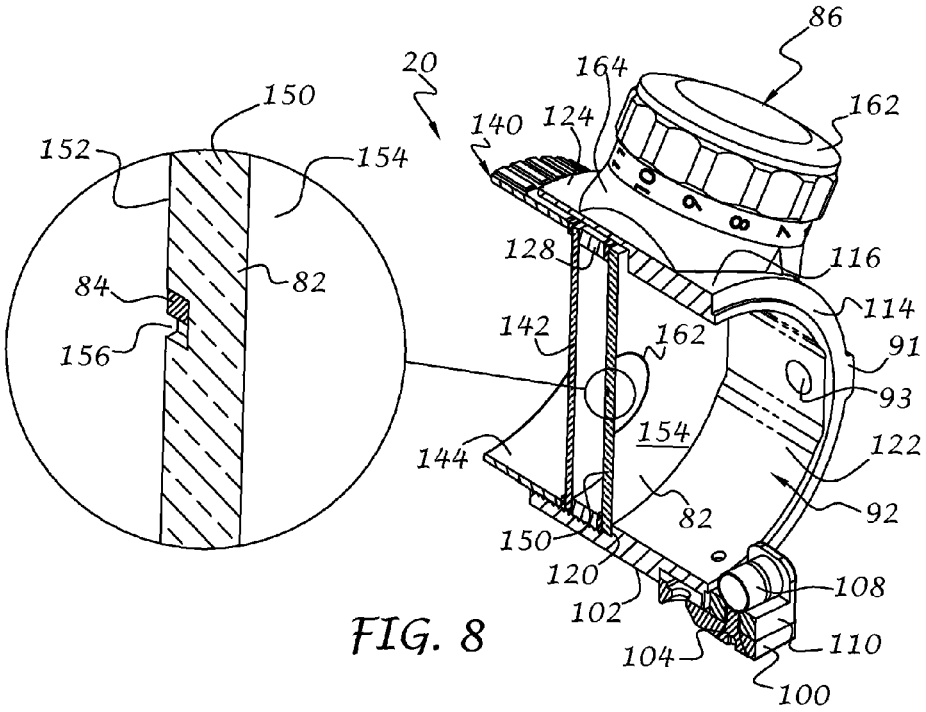
FIG. 8 is an isometric sectional view of the sight assembly taken along line 8-8 of FIG. 5 with the additional lens module connected thereto and showing an enlarged isometric detail view of the light source position with respect to the lens.

As best shown in FIGS. 7 and 8, an image assembly 140 can be connected to the forward end 124 of the housing 90 for protecting the lens 82 and/or modifying an image as viewed through the lens 82. For example, the image assembly 140 can be used as a lens cap, or to magnify an image viewed through the sight window 92, filter one or more wavelengths of light as it passes through the image assembly 140, reduce glare or reflection, reduce the brightness of light coming through the sight window 92, and so on. The image assembly 140 can include one or more secondary lenses, such as lens 142, and a second annular locking ring 144 for securing the lens 142 within the housing 90. The second locking ring 144 has outer threads 146 that engage the internal threads 132 of the circular wall 90 so that the lens 142 is sandwiched between the first locking ring 128 and the second locking ring 144. An outer knurled surface 148 is formed on the second locking ring 144 to facilitate grasping by a user when installing and removing the lens 142. Although only a single lens 142 is shown, the second locking ring 144 can include one or more lenses, transparent or translucent plates, light filters, and so on.

As best shown in FIGS. 5, 6, 8, 10, and 11, the lens 82 can be constructed of a transparent plastic material such as acrylic, polycarbonate, glass, fused silica, or any suitable transparent material. The lens 82 preferably includes a transparent plate-like structure 150 having a front surface 152 that faces a distant target and a rear surface 154 that faces a user. The surfaces 152 and 154 can be flat as shown, or can be curved to produce an image modifying effect with or without one or more further lenses, to magnify an image viewed through the aperture, and so on. As shown, the sight dot, in the form of a miniature LED 84 as previously described, is positioned in a depression or indentation 156 formed in the front surface 152 of the lens 82. The LED is preferably completely located within the depression 156 so that it is completely protected from foreign objects that might separate the LED if it had been installed unprotected on the outer surface. Although the depression 156 is shown formed in the lens 82, the depression can be formed by creating a peripheral ridge or projection extending from the front surface 152 and surrounding the LED. The LED 84 can be fixed in the depression through adhesive bonding, soldering, mechanical fastening, or other known connection means.

Ultra-thin conductors or conductive traces 158 and 160 (best shown in FIG. 5) are formed on the front surface 152 and extend across the lens from the LED in opposite directions, and are electrically connected to the LED through soldering or other known electrical connection means. Due to the relatively low power requirements of the LED, because of its size and the relatively low light level output, the conductors 158 and 160 can be made thin enough so as to disappear from view when held at arm's length by a user, yet complete the electrical pathway to the electrical power source 86, thus giving the optical illusion that the LED sight point is floating in midair. This can be useful when shooting targets at long distances, because the aiming indicia will block less of the target.

The conductors 158 and 160 are in turn electrically connected to circular conductor portions 158A and 160A (best shown in FIGS. 10 and 11), respectively, that extend around a portion of the outer periphery of the lens 82 on the front surface 152 of the lens 82. The conductor portions 158A and 160A are in turn connected to the electrical power source 86 via electrical leads or terminals (not shown) that contact the conductor portions for selectively illuminating and controlling brightness of the LED, upon rotation of a switch cover 162 associated with the power source 86 in a known manner. The miniature conductors 158, 160 and their associated peripheral conductor portions 158A and 160A are preferably permanently formed on the front surface 152 of the lens 82 through well-known forming means depending on the material of the lens and the conductors, such as vacuum deposition, silk-screening, printing, plating, adhesive bonding, welding, painting, and so on.

Figure 10:
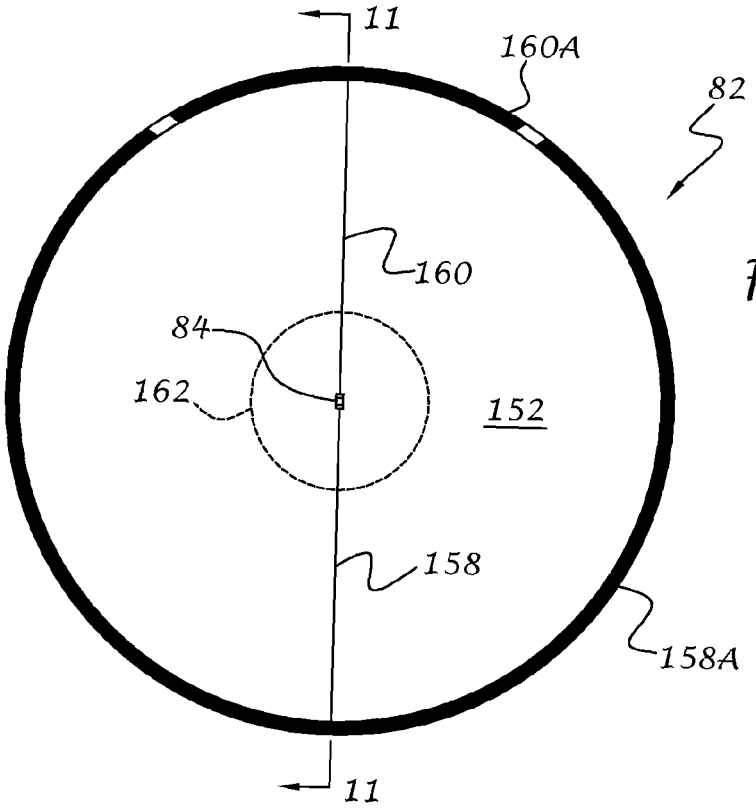
FIG. 10 is an enlarged front elevational view of a lens assembly in accordance with an exemplary embodiment of the invention.
Figure 11:
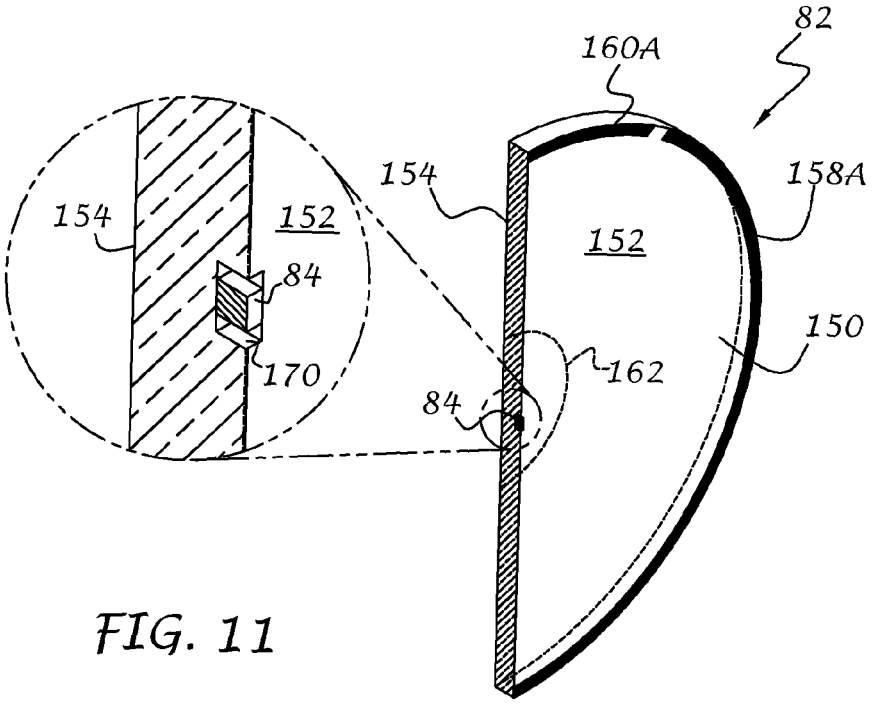
FIG. 11 is a sectional view thereof taken along line 11-11 of FIG. 10 with an enlarged area showing details of the light source position similar to the FIG. 9 embodiment.
Figure 12:
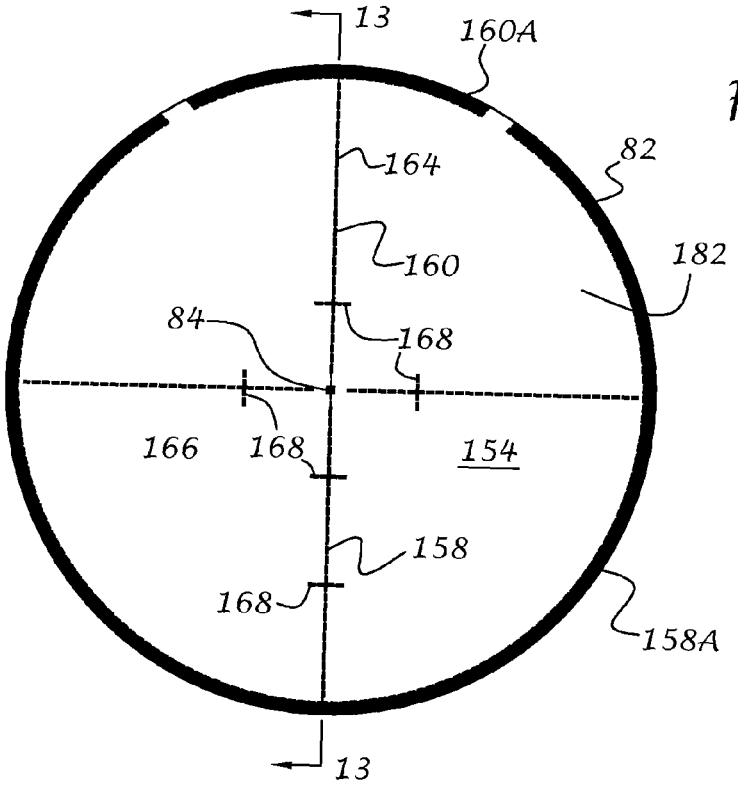
FIG. 12 is an enlarged front elevational view of a lens assembly in accordance with a further exemplary embodiment of the invention.

The rear surface 154 of the lens 82 can have aiming indicia including one or more circular rings 162, as shown in FIGS. 6 and 10 for example, crosshairs 164, 166 with tick marks 168 as shown in FIG. 12 thereof, as well as combinations thereof or any other aiming indicia. It will be understood that the aiming indicia can be removed without departing from the spirit and scope of the invention, so that the LED appears to be suspended as viewed by a user.

As shown in FIG. 7, the power source 86 includes a fixed mounting base 164 mounted on the housing 90 via fasteners 166. The switch cover 162 is rotatably connected to the mounting base 164. Internal components of the power source 86, including switches, springs, detents, one or more batteries, and so on, as well as their arrangement and operation, are well known and therefore will not be further described.

Figure 9:
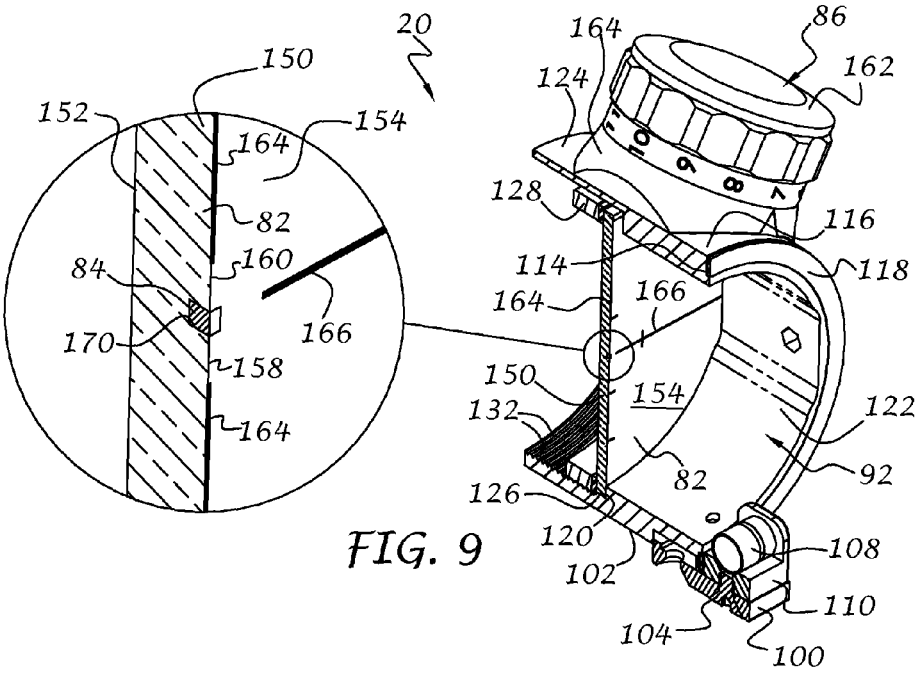
FIG. 9 is an isometric sectional view of the sight assembly similar to FIG. 8 and showing an enlarged isometric detail view of a modified light source position with respect to the lens, along with cross-hair aiming indicia in accordance with further embodiments of the invention.

Referring to FIG. 9, and in accordance with a further embodiment of the invention, the LED 84 can be positioned in a depression or indentation 170 formed in the rear surface 154 of the lens 82. As in the FIG. 8 embodiment, the LED 84 is preferably completely located within the depression 170 so that it is completely protected from foreign objects that might separate the LED if it had been installed unprotected on the outer surface. Although the depression 170 is shown formed in the rear surface 154 of the lens 82, the depression can be formed by creating a peripheral ridge or projection extending rearwardly from the surface 154 and surrounding the LED. In this embodiment, separate conductors and circular conductor portions can be provided on either side of the lens 82. In accordance with a further embodiment of the invention, the crosshairs 164, 166 or other aiming indicia can be constructed of conductive material and deposited on one or both surfaces of the lens 82. In this manner, the aiming indicia can be used to bring electrical power to the LED 84 rather than separate ultra-thin conductive traces.

In accordance with yet a further embodiment of the invention, a protective transparent lens, coating, potting material, and so on, can fill the indentation around the LED and/or can extend across the indentation and the surface of the lens to thereby encapsulate the LED 84 and protect it from the outside environment.

Figure 13:
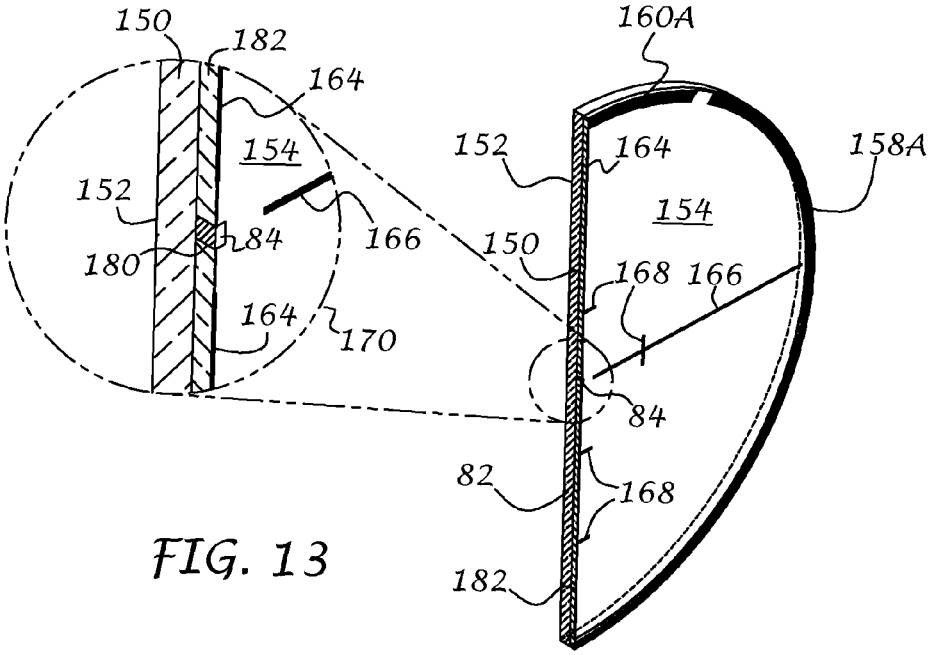
FIG. 13 is a sectional view thereof taken along line 13-13 of FIG. 12 with an enlarged area showing details of a modified light source position in accordance with another exemplary embodiment of the invention.

Referring now to FIGS. 12 and 13, and in accordance with yet a further embodiment of the invention, the LED 84 can be positioned in a depression or indentation 180 formed in a protective lens 182, which can be in the form of a plate, sheet, film, coating or the like. The protective lens 182 can be connected or applied to either the forward or rear surface of the lens 82 and completely surrounds and isolates the LED from the outside environment. The protective lens 182 also isolates the aiming indicia 164, 166, 168 as well as the conductive traces when formed on the same surface to which the protective cover is connected. In this manner, the lens 82 can be formed without the indentation or depression while protecting the LED.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, a plurality of lenses can be used to attain a particular image modification effect, such as magnification. Moreover, a plurality of LED's or other light sources can be mounted on one or more lenses as previously described to accommodate different distances to the target when the lens is normally stationary with respect to the archery bow. Furthermore, each LED can be mounted to a different lens with one lens being stationary and the other lenses moving up and down to adjust the aiming points to various distances depending on the particular archery bow parameters. It will be understood, therefore, that the present invention is not limited to the particular embodiments disclosed, but also covers modifications within the spirit and scope of the invention as defined by the appended claims.

What is claimed is:

1. A sight assembly for aiming at a distant target by a user, the sight assembly comprising:

a sight housing having a sight window;

a first lens connected to the housing in alignment with the sight window, the first lens having a front surface for facing the distant target and a rear surface for facing the user;

a depression formed in the first lens and associated with one of the front surface and the rear surface, wherein a depth of the depression is less than a thickness of the first lens so that the depression does not extend through the first lens; and an illuminated sight point for superimposing on the distant target, the illuminated sight point comprising an electrically powered light source located completely in the depression, to thereby protect the light source from foreign objects that might otherwise separate the light source from the lens.

2. A sight assembly according to claim 1, wherein the depth of the depression is greater than or equal to a height of the electrically powered light source so that the light source is located completely in the depression.

3. A sight assembly according to claim 1, wherein the depression is formed in the front surface of the first lens and the electrically powered light source is positioned within the depression and oriented so that radiant energy from the electrically powered light source projects rearwardly through a remaining thickness of the first lens between the rear surface and a bottom of the depression for viewing by a user when the sight assembly is in an aiming position.

4. A sight assembly according to claim 3, wherein the depression is formed at an axial center of the first lens.

5. A sight assembly according to claim 3, and further comprising first and second conductive traces located on the first lens, the conductive traces extending across the first lens and being electrically connected to the electrically powered light source and electrically connectable to an electrical power source for selectively powering the electrically powered light source, thereby selectively creating the illuminated sight point.

6. A sight assembly according to claim 5, wherein the first and second conductive traces extend in opposite directions along the first lens.

7. A sight assembly according to claim 5, and further comprising first and second circular conductor portions formed along an outer periphery of the first lens, the first and second conductor portions being electrically connected to the first and second conductive traces.

8. A sight assembly according to claim 7, and further comprising an electrical power source connected to the housing and electrically connectable to the circular conductor portions, the electrical power source including a multi-position switch for providing electrical power at different intensities to the electrically powered light source to thereby selectively vary brightness levels of the electrically powered light source.

9. A sight assembly according to claim 5, wherein the conductive traces are formed as aiming indicia on the first lens.

10. A sight assembly according to claim 5, wherein the light source and conductive traces are associated with the front surface of the first lens, and further comprising aiming indicia associated with the rear surface of the first lens.

11. A sight assembly according to claim 1, and further comprising a second lens extending across at least a portion of the first lens to thereby protect at least the portion of the first lens.

12. A sight assembly according to claim 11, and further comprising:

an internal annular shoulder located in the housing;

an internally threaded portion extending from a forward end of the housing toward the internal annular shoulder;

a first locking ring with external threads for engaging the internally threaded portion;

wherein the first lens is sandwiched between the internal annular shoulder and the first locking ring to thereby securely hold the first lens within the sight window; and a second locking ring with external threads for engaging the internally threaded portion of the housing;

wherein the second lens is sandwiched between the first locking ring and the second locking ring to thereby securely hold the second lens in the sight window.

13. A sight assembly according to claim 1, wherein the electrically powered light source comprises a miniature surface-mount LED with a height that is equal to or less than the depth of the depression such that the LED is located entirely within the depression.

14. A sight assembly according to claim 1, and further comprising:

an internal annular shoulder located in the housing;

an internally threaded portion extending from a forward end of the housing toward the internal annular shoulder; and a first locking ring with external threads for engaging the internally threaded portion;

wherein the first lens is sandwiched between the internal annular shoulder and the first locking ring to thereby securely hold the first lens within the sight window.

15. A sight assembly according to claim 14, and further comprising:

a second lens in alignment with the first lens; and a second locking ring with external threads for engaging the internally threaded portion of the housing;

wherein the second lens is sandwiched between the first locking ring and the second locking ring to thereby securely hold the second lens in the sight window.

16. An archery sight comprising the sight assembly of claim 1, and further comprising:

a bracket assembly having a first bracket portion for connection to an archery bow and a second bracket portion connected to the sight assembly, the second bracket portion being adjustable along windage and elevation directions to thereby permit the sight assembly to be tuned in for a particular set of archery parameters.

17. A sight assembly according to claim 1, wherein the depression is formed in the rear surface of the lens and the electrically powered light source is positioned within the depression and oriented so that radiant energy from the electrically powered light source projects rearwardly for viewing by a user when the sight assembly is in an aiming position.

18. A sight assembly according to claim 1, wherein the electrically powered light source comprises a miniature surface-mount LED that forms the illuminated sight point, the miniature surface-mount LED having a height that is less than or equal to the depth of the depression such that the entire miniature surface-mount LED is located completely in the depression.

19. A sight assembly, for aiming at a distant target by a user, the sight assembly comprising:

a sight housing having a sight window;

a first lens connected to the housing in alignment with the sight window, the first lens having a front surface for facing the distant target and a rear surface for facing the user;

a second lens positioned against the first lens for protecting the first lens;

a depression defined by an opening extending through the second lens and terminating at one of the first and second surfaces of the first lens, such that a depth of the depression is less than a combined thickness of the first and second lenses; and an illuminated sight point for superimposing on the distant target, the illuminated sight point comprising a miniature electrically powered light source located completely within the opening formed in the second lens, such that the second lens together with the first lens surrounds and isolates the light source from the outside environment.

20. A sight assembly according to claim 19, and further comprising first and second conductive traces located between the first and second lenses to thereby isolate and protect the conductive traces from the outside environment, the first and second conductive traces being electrically connected to the electrically powered light source and extending across one of the first and second lenses for electrical connection to an electrical power source for selectively powering the electrically powered light source, thereby selectively creating the illuminated sight point.

* * * * *